United States Patent [19]

Iizuka et al.

[11] 4,365,597

[45] Dec. 28, 1982

[54] SPLIT TYPE INTERNAL COMBUSTION ENGINE

[75] Inventors: Haruhiko Iizuka, Yokosuka; Fukashi Sugasawa, Yokohama, both of Japan

[73] Assignee: Nissan Motor Company, Limited, Yokohama, Japan

[21] Appl. No.: 206,141

[22] Filed: Nov. 12, 1980

[30] Foreign Application Priority Data

Nov. 15, 1979 [JP] Japan ..... 54-148213

[51] Int. Cl.[3] ..... F02D 17/00

[52] U.S. Cl. ..... 123/198 F; 123/481; 123/580

[58] Field of Search ..... 123/198 F, 580, 481

[56] References Cited

U.S. PATENT DOCUMENTS

| | | | |
|---|---|---|---|
| 3,400,702 | 9/1968 | Watkins | 123/198 F |
| 3,578,116 | 5/1971 | Nakajima et al. | 123/198 F |
| 4,107,921 | 8/1978 | Iizuka | 123/198 F |
| 4,201,180 | 5/1980 | Lizuka | 123/198 F |
| 4,292,938 | 10/1981 | Tanaka et al. | 123/198 F |
| 4,296,719 | 10/1981 | Takahashi et al. | 123/198 F |
| 4,303,053 | 12/1981 | Etoh et al. | 123/198 F |
| 4,304,208 | 12/1981 | Etoh et al. | 123/198 F |
| 4,320,726 | 3/1982 | Etoh et al. | 123/198 F |

FOREIGN PATENT DOCUMENTS

| | | |
|---|---|---|
| 665392 | 9/1938 | Fed. Rep. of Germany . |
| 1903413 | 7/1972 | Fed. Rep. of Germany . |
| 2844309 | 10/1979 | Fed. Rep. of Germany . |
| 2413547 | 7/1979 | France . |

OTHER PUBLICATIONS

ATZ 81 (1979) 6, pp. 255–260.

"Entwicklungslinien in Kraftfahrzeugtechnik und Strassenverkehr," Forschungsbilanz 1978, Untersuchungen zur Verbrauchssenkung am Ottomotor durch besondere Prozess-fuhrung, by Hockel et al.

*Primary Examiner*—Ira S. Lazarus

*Attorney, Agent, or Firm*—Schwartz, Jeffery, Schwaab, Mack, Blumenthal & Koch

[57] ABSTRACT

An internal combustion engine is disclosed which includes first and second cylinder units, an intake manifold divided into first and second intake passages leading to the first and second cylinder units, respectively, an exhaust manifold divided into first and second exhaust passages leading from the first and second cylinder units, respectively, and control means for providing a control signal to disable the second cylinder unit when the engine load is below a predetermined value. The second intake passage has therein a first normally open valve adapted to close in response to the control signal. The second exhaust passage has therein a second normally open valve adapted to close in response to the control signal. Pressure control means is provided which is responsive to the control signal for supplying a predetermined pressure not less than atmospheric pressure to the second intake passage, thereby maintaining the second intake passage at the predetermined pressure.

7 Claims, 3 Drawing Figures

SPLIT TYPE INTERNAL COMBUSTION ENGINE

BACKGROUND OF THE INVENTION

1. Field of the Invention

The invention relates to improvements in an internal combustion engine of the split type operable on less than all of its cylinders when the engine load is below a given value.

2. Description of the Prior Art

It is known and desirable to increase the efficiency of a multicylinder internal combustion engine by reducing the number of cylinders on which the engine operates under predetermined engine operating conditions, particularly conditions of low engine load. Control systems have already been proposed which disable a number of cylinders in a multicylinder internal combustion engine by suppressing the supply of fuel to certain cylinders or by preventing the operation of the intake and exhaust valves of selected cylinders. Under given engine load conditions, the disablement of some of the cylinders of the engine increases the load on the those remaining in operation and, as a result, the energy conversion efficiency is increased.

One difficulty with such split type internal combustion engines is that large torque variations occurs, in spite of the use of a flywheel for output torque smoothing, causing large vibrations on the engine and vehicle body during the disablement of some of the cylinders, particularly under low speed conditions such as idling conditions. This is stemmed mainly from the structure where the period of rotation of the crankshaft is elongated during the disablement of some of the cylinders.

The present invention provides an improved split type internal combustion engine which can minimize vibrations on engine and vehicle bodies which have been found under low speed conditions by maintaining the period of engine output torque uncharged between full and split engine modes of operation.

SUMMARY OF THE INVENTION

The present invention provides an internal combustion engine which comprises first and second cylinder units each including at least one cylinder, an intake manifold divided into first and second intake passages leading to the first and second cylinder units, respectively, an exhaust manifold divided into first and second exhaust passages leading from the first and second cylinder units, respectively, and control means for providing a control signal to disable the second cylinder unit when the engine load is below a predetermined value. The second intake passage has therein first normally open valve means adapted to close in response to the control signal. The second exhaust passage has therein second normally open valve means adapted to close in response to the control signal.

Pressure control means is provided which is responsive to the control signal for supplying a predetermined pressure not less than atmospheric pressure to the second intake passage, thereby maintaining the second intake passage at the predetermined pressure. This permits the second cylinder unit to absorb a part of the torque released on the crankshaft from the first cylinder unit upon the compression stroke and to release the absorbed torque on the crankshaft upon the power stroke. As a result, the period of engine output torque is held uncharged between full and split engine modes of operation.

The pressure control means may be comprised of a pump having an inlet communicated with atmospheric air and an outlet connected through a check valve to the second intake passage, and means for operating the pump in response to the control signal. Preferably, the inlet of the pump may be connected to the exhaust duct for introducing exhaust gases into the second intake passage. This can maintain an associated catalytic converter at elevated temperature for high pollutant removal efficiency. Alternatively, the pressure control means may be comprised of a normally closed two-way valve having an inlet communicated with atmospheric air and an outlet connected through a check valve to the second intake passage. The two-way valve is adapted to open in response to the control signal.

The present invention is applicable with split type internal combustion engine having an EGR system for recirculating exhaust gases to the second intake passage during a split engine mode of operation. The recirculated exhaust gases serves to increase the pressure in the second intake passage.

BRIEF DESCRIPTION OF THE DRAWINGS

The present invention will be described in greater detail by reference to the following description taken in connection with the accompanying drawings, in which like reference numerals refer to the same or corresponding parts, and wherein.

DESCRIPTION OF THE PREFERRED EMBODIMENTS

Figure 1:
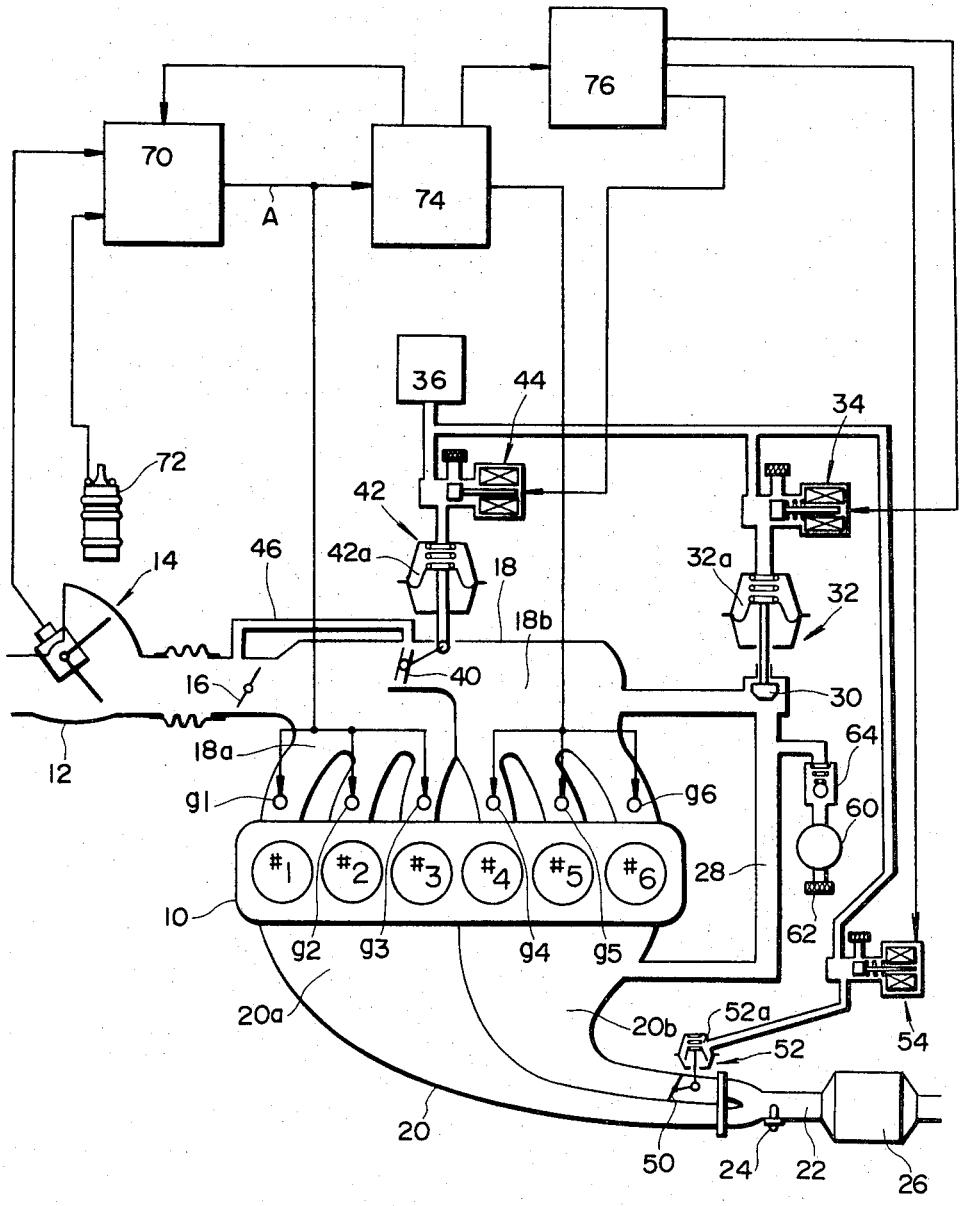
FIG. 1 is a schematic view showing one embodiment of a split type internal combustion engine constructed in accordance with the present invention.

Referring now to FIG. 1, the reference numeral 10 designates an engine block containing therein an active cylinder unit including three cylinders #1 to #3 being always active and an inactive cylinder unit including three cylinders #4 to #6 being inactive when the engine load is below a predetermined value. Air is supplied to the engine through an air induction passage 12 provided therein with an airflow meter 14 and a throttle valve 16 drivingly connected to the accelerator pedal (not shown) for controlling the flow of air to the engine. The induction passage 12 is connected downstream of the throttle valve 16 to an intake manifold 18 which is divided into first and second intake passages **18*a* and 18*b*. The first intake passage 18*a* leads to the active cylinders #1 to #3 and the second intake passage 18*b* leads to the inactive cylinders #4 to #6**.

The engine also has an exhaust manifold 20 which is divided into first and second exhaust passages **20*a* and 20*b* leading from the active cylinders #1 to #3 and the inactive cylinders #4 to #6, respectively. The exhaust manifold 20 is connected at its downstream end to an exhaust duct 22 provided therein with an exhaust gas sensor 24 and an exhaust gas purifier 26 located downstream of the exhaust gas sensor 24. The exhaust gas sensor 24** may be in the form of an oxygen sensor which monitors the oxygen content of the exhaust and is effective to provide a signal indicative of the air/fuel ratio at which the engine is operating. The exhaust gas purifier 26 may be in the form of a three-way catalytic converter which effects oxidation of HC and CO and reduction of NOx so as to minimize the emission of pollutants through the exhaust duct 22. The catalytic converter exhibits its maximum performance above a temperature. In view of this, it is preferable to maintain the catalytic converter at elevated temperatures.

An exhaust gas recirculation (EGR) passage 28 is provided which has its one end opening into the second exhaust passage 20*b* and the other end thereof opening into the second intake passage 18*b*. The EGR passage 28 has therein an EGR valve 30 which opens to permit recirculation of exhaust gases from the second exhaust passage 20*b* into the second intake passage 18*b* so as to minimize pumping losses in the inactive cylinders #4 to #6 during a split engine mode of operation where the engine operates on the three cylinders #1 to #3. The EGR valve 30 closes to prevent exhaust gas recirculation during a full engine mode of operation where the engine operates on all of the cylinders #1 to #6.

The EGR valve 30 is driven by a first pneumatic valve actuator 32 which includes a diaphragm spreaded within a casing to define therewith two chambers on the opposite sides of the diaphragm, and an operating rod having its one end centrally fixed to the diaphragm and the other end thereof drivingly connected to the EGR valve 30. The working chamber 32*a* is connected to the outlet of a first three-way solenoid valve 34 which has an atmosphere inlet communicated with atmospheric air and a vacuum inlet connected to a vacuum tank 36. The first solenoid valve 34 is normally in a position providing communication of atmospheric pressure to the working chamber 32*a* of the first valve actuator 32 so as to close the EGR valve 30. During a split engine mode of operation, the first solenoid valve 34 is moved to another position where communication is established between the vacuum tank 36 and the working chamber 32*a* of the first valve actuator 32, thereby opening the EGR valve 30.

The second intake passage 18*b* is provided at its entrance with a first stop valve 40. The first stop valve 40 is driven by a second pneumatic valve actuator 42 which is substantially similar in structure to the first valve actuator 32. The working chamber 42*a* of the second valve actuator 42 is connected to the outlet of a second threeway solenoid valve 44 which has an atmosphere inlet communicated with atmospheric air and a vacuum inlet connected to the vacuum tank 36. The second solenoid valve 44 is normally in a position providing communication of atmospheric pressure to the working chamber 42*a* of the second valve actuator 42 so as to open the first stop valve 40. When the engine operation is in a split engine mode, the first solenoid valve 44 is moved to another position where communication is established between the vacuum tank 36 and the working chamber 42*a* of the second valve actuator 42 so as to close the first stop valve 40, thereby blocking the flow of air into the inactive cylinders #4 to #6 and precluding escape of exhaust gases charged in the second intake passage 18*b* into the first intake passage 18*a*.

The stop valve 40 may be in the form of a double-faced butterfly valve having a pair of valve plates facing in spaced-parallel relation to each other. A conduit 46 is provided which has its one end opening into the induction passage 12 at a point upstream of the throttle valve 16 and the other end thereof opening into the second intake passage 18*b*, the other end being in registry with the space between the valve plates when the stop valve 40 is at its closed position. Air, which is substantially at atmospheric pressure, is introduced through the conduit 46 into the space between the valve plates so as to ensure that the exhaust gases charged in the second intake passage 18*b* cannot escape into the first intake passage 18*a* when the stop valve 40 is closed.

The second exhaust passage 20*b* is provided with a second stop valve 50 downstream of the position where the EGR passage 28 opens into the second exhaust passage 20*b*. The second stop valve 50 is driven by a third pneumatic valve actuator 52 which is substantially similar in structure to the first valve actuator 32. The working chamber 52*a* of the third valve actuator 52 is connected to the outlet of a third three-way solenoid valve 54 which has an atmosphere inlet communicated with atmospheric air and a vacuum inlet connected to the vacuum tank 36. The third solenoid valve 54 is normally in a position providing communication of atmospheric pressure to the working chamber 52*a* of the third valve actuator 52 so as to open the second stop valve 50. When the engine operation is in a split engine mode, the third solenoid valve 54 is moved to another position where communication is provided between the vacuum tank 36 and the working chamber 52*a* of the third valve actuator 52 so as to close the second stop valve 50, thereby blocking the flow of exhaust gases from the second exhaust passage 20*b* to the exhaust duct 22.

A pump 60 is provided which sucks air through an air filter 62 and supplies pressurized air through a check valve 64 to the EGR passage 28 upstream of the EGR valve 30. The pump 60 has a relief valve for preventing the pressure of the pressurized air from exceeding a predetermined value. The pump 60 is associated with an electromagnetic clutch (not shown) for permitting the operation of the pump 60 only when the engine operation is in a split engine mode.

The reference numeral 70 designates an injection control circuit which provides, in synchronism with engine speed such as represented by spark pulses from an ignition coil 72, a fuel-injection pulse signal A of pulse width proportional to the air flow rate sensed by the airflow meter 14 and corrected in accordance with an air/fuel ratio indicative signal from the exhaust gas sensor 24. The fuel-injection pulse signal A is applied directly to fuel injection valves $g_1$ to $g_3$ for supplying fuel to the respective cylinders #1 to #3 and also through a split engine operating circuit 74 to fuel injection valves $g_4$ to $g_6$ for supplying fuel to the respective cylinders #4 to #6. Each of the fuel injection valves $g_1$ to $g_6$ may be in the form of an ON-OFF type solenoid valve adapted to open width of the fuel-injection pulse signal.

The split engine operating circuit 74 determines the load at which the engine is operating based upon the pulse width of the fuel injection pulse signal. At high load conditions, the split engine operating circuit 74 permits the passage of the fuel-injection pulse signal to the fuel injection valves $g_4$ to $g_6$ and provides a high load indicative signal to a valve drive circuit 76. The valve drive circuit 76 is responsive to the high load indicative signal to hold the first, second and third three-way valves 34, 44 and 54 in their normal position, thereby closing the EGR valve 30 and opening the first and second stop valves 40 and 50. When the engine load falls below a given value, the split engine operating circuit 74 blocks the flow of the fuel-injection pulse signal to the fuel injection valves $g_4$ to $g_6$ and also provides a low load indicative signal to the valve drive circuit 76 which thereby changes the positions of the first, second and third three-way solenoid valves 34, 44 and 54, thereby opening the EGR valve 30 and closing the first and second stop valves 40 and 50.

The operation of the present invention is as follows: At high load conditions, the split engine operating circuit 74 provides a high load indicative signal to the valve drive circuit 76 which thereby maintains the first, second and third three-way valves 34, 44 and 54 in their normal positions. As a result, the EGR valve 30 closes to prevent the recirculation of exhaust gases through the EGR passage 28 to the second intake passage 18*b*. The first stop valve 40 opens to permit the flow of air through the second intake passage 18*b* into the cylinders #4 to #6. The second stop valve 50 opens to connect the second exhaust passage 20*b* to the exhaust duct 22. In addition, the split engine operating circuit 74 permits the passage of the fuel-injection pulse signal from the injection control circuit 70 to the fuel injection valves $g_4$ to $g_6$. Accordingly, the engine operates on all of the cylinders #1 to #6.

When the engine load falls below a given value, the split engine operating circuit 74 provides a low load indicative signal to the valve drive circuit 76 which thereby changes the first, second and third three-way valves 34, 44 and 54 to another positions. The result is that the EGR valve 30 opens to permit recirculation of exhaust gases through the EGR passage 28 into the second intake passage 18*b*. The first stop valve 40 closes to block the flow of air through the second intake passage 18*b* to the cylinders #4 to #6. The second stop valve 50 closes to disconnect the second exhaust passage 20*b* from the exhaust duct 22. In addition, the split engine operating circuit 74 blocks the passage of the fuel-injection pulse signal from the injection control circuit 70 to the fuel injection valves $g_4$ to $g_6$. Accordingly, the engine operates only on the cylinders #1 to #3.

During this split engine mode of operation, the pump 60 operates. When the pressure in the second intake passage 18*b* falls below a predetermined value substantially equal to the pressure at the output side of the pump 60, the check valve 64 opens to permit the second intake passage 18*b* to be supplied with air pressure and held at the predetermined pressure. The inactive cylinders #4 to #6 suck the pressure air upon their intake stroke and compresses it upon their compression stroke. During the compression stroke, the inactive cylinders absorb a part of the torque released on the crankshaft from the active cylinders #1 to #3. Upon the power stroke of the inactive cylinders #4 to #6, the absorbed torque is released on the crankshaft as the pressure air expands therein. As a result, the period of the output torque transmitted to the crankshaft can be reduced to the same value as obtained during a full engine mode of operation. Furthermore, highly smoothed engine output torque can be achieved since a part of the torque released on the crankshaft from the active cylinders #1 to #3 is absorbed during the compression stroke of the inactive cylinders #4 to #6.

During the split engine mode of operation, the second stop valve 50 closes to disconnect the second exhaust passage 20*b* from the exhaust duct 22 so as to prevent the pressure air from flowing to the exhaust duct 22. This is effective to maintain the second intake passage 18*b* at the predetermined pressure and maintain the catalytic converter 26 at elevated temperatures sufficient for high pollutant removal efficiency.

It is to be noted that the pump 60 may be adapted to operate after the pressure in the second intake passage 18*b* falls below the predetermined value during a split engine mode of operation.

When the engine operation is shifted from the split engine mode to a full engine mode, the pump 60 stops from operating and the second stop valve 50 opens to permit smooth flow of exhaust gases from the cylinders #4 to #6 to the exhaust duct 22.

Figure 2:
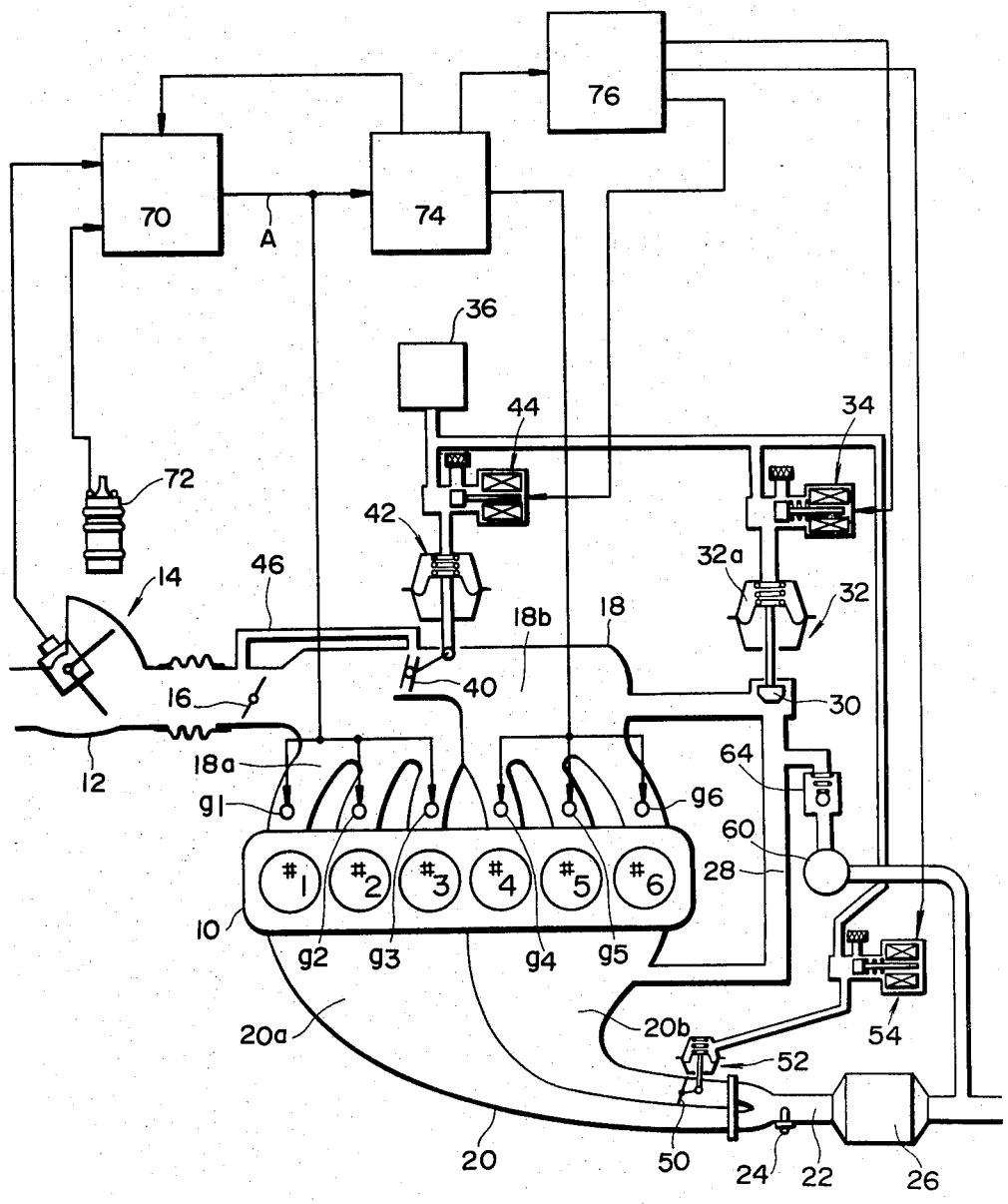
FIG. 2 is a schematic view showing a second embodiment of the present invention.

Referring to FIG. 2, there is illustrated a second embodiment of the present invention which is substantially similar to the first embodiment except that the inlet side of the pump 60 is connected to the exhaust duct 22 downstream of the catalytic converter 26 rather than to atmospheric air. That is, the pump 60 sucks exhaust gases from the exhaust duct 22 and supplies pressurized exhaust gases through the check valve 64 to the second intake passage 18*b* so as to maintain the second intake passage 18*b* at the predetermined pressure during a split engine mode of operation. This arrangement provides an additional advantage such as to reduce the amount of cool air flowing to the catalytic converter 26 when the engine operation is shifted from a split engine mode to a full engine mode. As a result, the catalytic converter 26 can be held at elevated temperatures sufficient for maximum pollutant removal efficiency over the full range of engine operating conditions.

Figure 3:
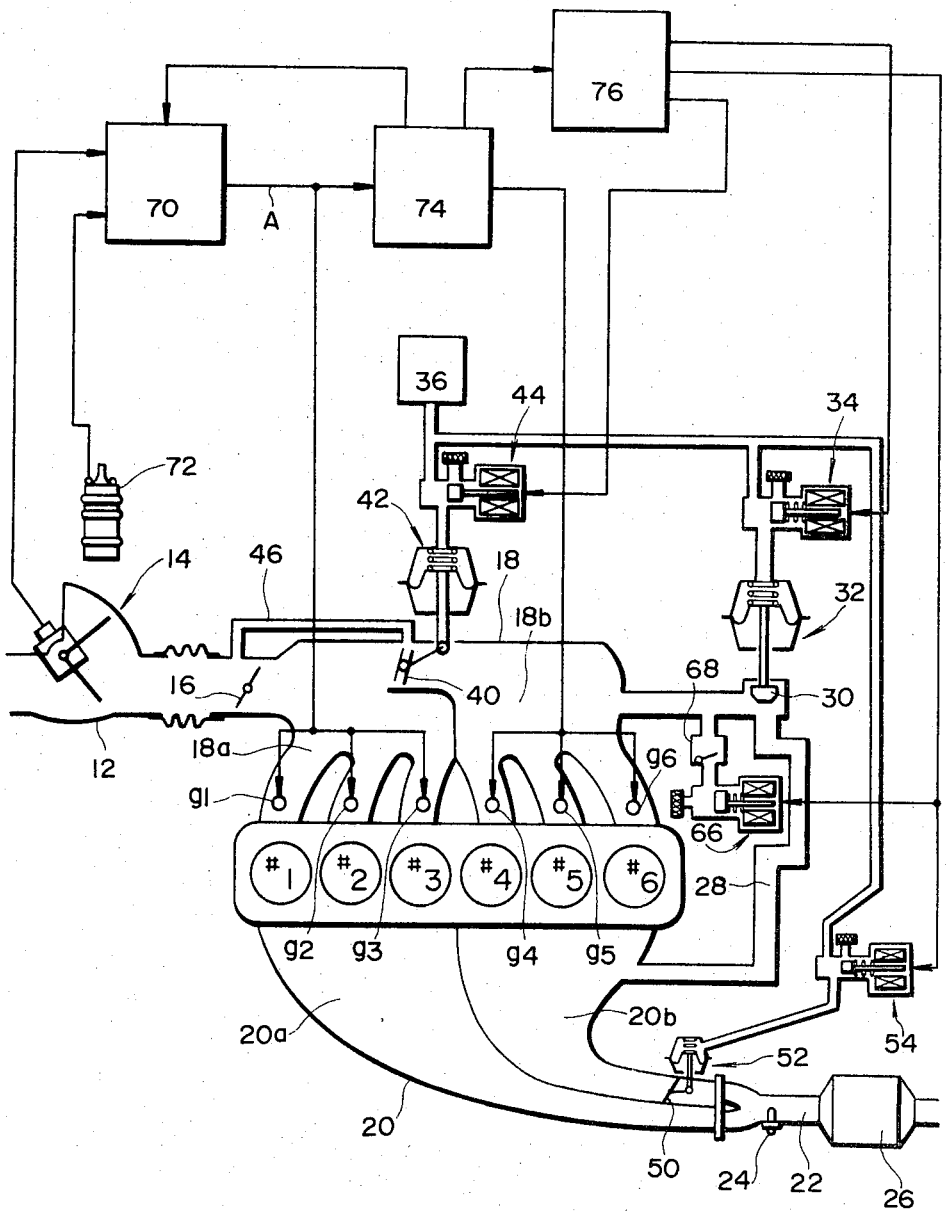
FIG. 3 is a schematic view showing a third embodiment of the present invention.

Referring to FIG. 3, there is illustrated a third embodiment of the present invention where the air pressure supply means including the pump 60 and the check valve 64 is replaced by another means including a normally closed solenoid valve 66. The solenoid valve 66 is responsive to the valve drive circuit 76 for providing communication between the second intake passage 18*b* and atmospheric air during a split engine mode of operation. When the pressure in the second intake passage 18*b* becomes negative, atmospheric pressure is introduced through the solenoid valve 66 to the second intake passage 18*b* to maintain it substantially at atmospheric pressure. This embodiment can eliminate the need for the pump.

It will be apparent from the foregoing that the present invention permits the inactive cylinders to provide torque on the crankshaft upon their power stroke during a split engine mode of operation. This results in a reduction of the period of engine output torque to the same value as obtained during a full engine mode of operation, thereby minimizing vibrations on the engine and vehicle body which have been found under low speed conditions such as idling conditions.

While the present invention has been described in connection with a six cylinder engine, it is to be noted that the particular engine shown is only for illustrative purposes and the structure of this invention could be readily applied to any split engine structure. In addition, while the present invention has been described in connection with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine including first and second cylinder units each including at least one cylinder, an intake manifold divided into first and second intake passages leading to said first and second cylinder units, respectively, an exhaust manifold divided into first and second exhaust passages leading from said first and second cylinder units, respectively, said exhaust manifold connected at its downstream end to an exhaust duct, and control means for providing a control signal to disable said second cylinder unit when the engine load is below a predetermined value, which comprises:

(a) first normally open valve means located in said second intake passage;

(b) second normally open valve means locaated at the outlet of said second exhaust passage;

(c) means responsive to the control signal from said control means for closing said first and second valve means; and (d) pressure control means responsive to the control signal from said control means for supplying a predetermined pressure not less than atmospheric pressure to said second intake passage, thereby maintaining said second intake passage at the predetermined pressure.

2. An internal combustion engine according to claim 1, wherein said pressure control means comprises a pump having an inlet communicated with atmospheric air and an outlet connected through a check valve to said second intake passage, and means for operating said pump in response to the control signal from said control means.

3. An internal combustion engine according to claim 1, wherein said pressure control means comprises an EGR passage having its one end opening into said second exhaust passage and the other end thereof opening into said second intake passage, a normally closed EGR valve located in said EGR passage and adapted to open in response to the control signal from said control circuit, a pump having an inlet communicated with atmospheric air and an outlet connected through a check valve to said EGR passage upstream of said EGR valve, and means for operating said pump in response to the control signal from said control means.

4. An internal combustion engine according to claim 1, wherein said pressure control means comprises a pump having an inlet communicated with said exhaust duct and an outlet connected through a check valve to said second intake passage, and means for operating said pump in response to the control signal from said control means.

5. An internal combustion engine according to claim 1, wherein said pressure control means comprises an EGR passage having its one end opening into said second exhaust passage and the other end thereof opening into said second intake passage, a normally closed EGR valve located in said EGR passage and adapted to open in response to the control signal from said control circuit, a pump having an inlet communicated with said exhaust duct and an outlet connected through a check valve to said second intake passage, and means for operating said pump in response to the control signal from said control means.

6. An internal combustion engine according to claim 1, wherein said pressure control means comprises a normally closed two-way valve having an inlet communicated with atmospheric air and an outlet connected through a check valve to said second intake passage, said two-way valve adapted to open in response to the control signal from said control means.

7. An internal combustion engine according to claim 1, wherein said pressure control means comprises an EGR passage having its one end opening into said second exhaust passage and the other end thereof opening into said second intake passage, a normally closed EGR valve located in said EGR passage and adapted to open in response to the control signal from said control circuit, a normally closed two-way valve having an inlet communicated with atmospheric air and an outlet connected through a check valve to said second intake passage, said two-way valve adapted to open in response to the control signal from said control means.

* * * * *